US007973623B2

(12) United States Patent
Andoh

(10) Patent No.: US 7,973,623 B2
(45) Date of Patent: Jul. 5, 2011

(54) STARTER FOR ENGINES AND ITS STARTING CIRCUIT

(75) Inventor: Kazuhiro Andoh, Okazaki (JP)

(73) Assignee: Denso Corporation, Kariya (JP)

( * ) Notice: Subject to any disclaimer, the term of this patent is extended or adjusted under 35 U.S.C. 154(b) by 305 days.

(21) Appl. No.: 12/219,512

(22) Filed: Jul. 23, 2008

(65) Prior Publication Data

US 2009/0026896 A1 Jan. 29, 2009

(30) Foreign Application Priority Data

Jul. 24, 2007 (JP) ..... 2007-192336
Jul. 24, 2007 (JP) ..... 2007-192389

(51) Int. Cl.
*H01H 67/02* (2006.01)
*F02N 11/00* (2006.01)
*F02N 11/08* (2006.01)
*H02P 9/04* (2006.01)

(52) U.S. Cl. ..... 335/126; 335/131; 335/132; 335/219; 335/220; 290/38 R; 290/38 C; 290/48; 123/179.3

(58) Field of Classification Search ..... 335/71, 335/75, 115, 126, 131, 132, 194, 219, 220, 335/162, 187, 255; 307/10.1–10.7, 9.1; 123/198 B, 123/146.5 R, 179.3, 179.5; 340/825.32, 340/825.34; 361/23, 24, 154, 160, 166–167, 361/194; 290/38 R, 38 C, 48
See application file for complete search history.

(56) References Cited

U.S. PATENT DOCUMENTS 1,744,868 A * 1/1930 Cox ..... 290/38 R
2,041,171 A * 5/1936 Dyer et al. ..... 290/38 R
2,301,440 A * 11/1942 Nardone ..... 123/179.22
2,939,964 A * 6/1960 Alexander et al. ..... 290/38 C
4,488,054 A * 12/1984 Ebihara ..... 290/38 A
4,559,455 A * 12/1985 Tanaka ..... 290/38 R (Continued)

FOREIGN PATENT DOCUMENTS

DE 10 2005 004326 A1 2/2006

(Continued)

OTHER PUBLICATIONS

Jun. 22, 2010 Office Action issued in Japanese Patent Application No. 2007-192336 (with translation).

(Continued)

*Primary Examiner* — Ahn T Mai
*Assistant Examiner* — Mohamad A Musleh
(74) *Attorney, Agent, or Firm* — Oliff & Berridge, PLC

(57) ABSTRACT

The starter has a system of pushing the pinion gear in the direction of the anti-motor side by using the attracting power of the electromagnetic switch via the shift lever. The switch coil of the electromagnetic switch is constituted of one coil that is electrically separated from the motor circuit. The mass of pinion gear is set to 100 g or less, the switch extrusion power stored in the drive spring is set to 70N (Newton) or less, and the operation current of the electromagnetic switch is set to 12 amperes or less. With this starter, since the switch coil and the motor circuit can be electrically separated, the terminal for connection for connecting the conventional attracting coil and conventional "M terminal bolt" can be abolished. Further, by setting the operation current of the electromagnetic switch 10 to 12 amperes or less, it is possible to control the operation current directly by the ECU.

8 Claims, 5 Drawing Sheets

U.S. PATENT DOCUMENTS

| | | | | |
|---|---|---|---|---|
| 4,732,120 | A | 3/1988 | Naito et al. | |
| 4,737,654 | A * | 4/1988 | Morishita et al. | 290/48 |
| 4,906,857 | A * | 3/1990 | Cummins et al. | 290/38 R |
| 5,494,010 | A | 2/1996 | Niimi et al. | |
| 5,656,981 | A | 8/1997 | Niimi et al. | |
| 5,679,935 | A | 10/1997 | Baba et al. | |
| 5,780,934 | A | 7/1998 | Imanishi et al. | |
| 6,354,257 | B1 * | 3/2002 | Marshall et al. | 123/179.3 |
| 6,404,310 | B1 | 6/2002 | Ando et al. | |
| 6,863,041 | B2 * | 3/2005 | Nagai et al. | 123/179.25 |
| 6,938,599 | B2 * | 9/2005 | Senda et al. | 123/179.3 |
| 7,034,643 | B1 | 4/2006 | Kusumoto et al. | |
| 2002/0017260 | A1 | 2/2002 | Saito et al. | |
| 2004/0168666 | A1 | 9/2004 | Nagai et al. | |
| 2006/0201266 | A1 * | 9/2006 | Kajino et al. | 74/6 |
| 2007/0139146 | A1 | 6/2007 | Kusumoto et al. | |
| 2007/0284234 | A1 * | 12/2007 | Kurasawa et al. | 200/400 |
| 2008/0024253 | A1 | 1/2008 | Kurasawa et al. | |
| 2008/0048454 | A1 | 2/2008 | Kurasawa et al. | |
| 2008/0127927 | A1 | 6/2008 | Hirning et al. | |

FOREIGN PATENT DOCUMENTS

| | | | |
|---|---|---|---|
| DE | 10 2006 032946 | A1 | 6/2007 |
| EP | 0 848 159 | A1 | 6/1998 |
| EP | 1 439 304 | A2 | 7/2004 |
| GB | 524535 | | 8/1940 |
| GB | 524538 | | 8/1940 |
| GB | 2 383 905 | A | 7/2003 |
| JP | B2-6-33749 | | 5/1994 |
| JP | 07-230751 | A | 8/1995 |
| JP | 08-167363 | A | 6/1996 |
| JP | 09-049479 | A | 2/1997 |
| JP | 09-177646 | A | 7/1997 |
| JP | A-2002-122059 | | 4/2002 |
| JP | B2-3478211 | | 12/2003 |
| JP | A-2004-190544 | | 7/2004 |
| JP | A-2005-54706 | | 3/2005 |
| JP | A-2006-233930 | | 9/2006 |
| JP | A-2006-266101 | | 10/2006 |
| JP | A-2007-154719 | | 6/2007 |
| JP | A-2008-25364 | | 2/2008 |
| JP | A-2008-31856 | | 2/2008 |

OTHER PUBLICATIONS

European Search Report, Nov. 11, 2008, pp. 1-4, European Patent Office, Netherlands.

Notification of Reasons for Rejection dated Jun. 22, 2010 in corresponding Japanese Patent Application No. 2007-192389 (with translation).

* cited by examiner

-- PRIOR ART --

-- PRIOR ART --

STARTER FOR ENGINES AND ITS STARTING CIRCUIT

CROSS-REFERENCE TO RELATED APPLICATION

This application is based on and claims the benefit of priority from earlier Japanese Patent Application No. 2007-192336 filed Jul. 24, 2007, and Japanese Patent Application No. 2007-192389 filed Jul. 24, 2007, the description of which is incorporated herein by reference.

BACKGROUND OF THE INVENTION

1. Technical Field of the Invention

The present invention relates to a starter for starting engines and its starting circuit, and in particular, to a starter having a system of pushing a pinion gear in the direction of an anti-motor side by using a shift lever driven by an electromagnetic switch.

2. Description of the Related Art

As disclosed in Japanese Patent No. 3478211, there is a starter for starting an engine with a conventional type of technology having a motor that generates a torque by energizing an armature and an electromagnetic switch that opens and closes a main point of contact provided in a motor circuit for energizing the motor with a current from a battery. There is provided a shift lever that is driven by using magnetic force generated by a switch coil of the electromagnetic switch and pushes a pinion gear and a clutch in the direction of an anti-motor side via a plunger and the shift lever.

Since this starter has a structure that the pinion gear and the clutch move together as a unit and a mass of a movable body is large, therefore it is necessary to increase the power of magnetic force. For that reason, there is adopted the electromagnetic switch having two coils for the switch coil, one for attracting and another for holding the plunger.

In the electromagnetic switch with two coils, the power of attraction is increased by energizing both the attracting coil and the holding coil, and reduces a combined resistance of the switch coil that increases an operation current. After the plunger is attracted and the main point of contact is closed, the attracting coil will become short-circuited by the main point of contact, and will be held at the state where the plunger is attracted only by magnetic force that the holding coil generates. Therefore, the attracting coil is energized only for a short time until the main point of contact is closed.

However, since the operating current for energizing the switch coil is large (about 40 amperes) for the electromagnetic switch with two coils, the operating current cannot be controlled directly by a switch with an ECU (electronic control unit).

Then, as shown in FIG. 6, a starter starting circuit 160 that controls an exciting current of a starter relay 140 by ECU is known. The starter relay 140 is arranged between a terminal 120 (generally called a 50 terminal) for energizing the switch coils (the attracting coil 100 and the holding coil 110) 150 and an ignition switch (it is hereafter called the IG switch 130).

Since the above-mentioned starter has the structure that the pinion gear and the clutch move together as the unit and the mass of the movable body is large, it is inevitably necessary to increase the power of magnetic force (attracting force).

That is, the electromagnetic switch has the attracting coil 100 and the holding coil 110 and when attracting the plunger, energizing both the attracting coil 100 and the holding coil 110 that reduces the combined resistance of both the coils 100 and 110 increases the operating current.

Further, if the plunger is attracted and the main point of contact is closed, the attracting coil 100 will be short-circuited by the main point of contact, and will be held at the state where a plunger is attracted only by the magnetic force that the holding coil 110 generates. Therefore, the attracting coil 100 is energized only for a short time until the main point of contact is closed.

However, it is necessary to connect the attracting coil to the motor circuit for the electromagnetic switch with two coils, i.e., the attracting coil 100 and the holding coil 110. To be more specific, a connecting terminal is attached to an M terminal bolt fixed to a contact point cover of the electromagnetic switch, and an end of the attracting coil 100 is connected to the connecting terminal by welding etc.

With this composition, the number of parts increases, and a process for attaching the connecting terminal to the M terminal bolt and a process for connecting the end of the attracting coil 100 to the connecting terminal (welding) is also required, thus the cost would rise.

Further, since it is necessary to form the switching circuit 170 for energizing the terminal 120 for energization via the starter relay 140, and the relay circuit 180 for controlling the exciting current of the starter relay 140 by the ECU 150 in the above-mentioned starting circuit 160, the circuit composition becomes complicated and causes the cost to rise as a vehicles system.

Furthermore, it is necessary to constitute the IG switch 130 in two lines in order to connect the switching circuit 170 and the relay circuit 180, thus the IG switch 130 becomes complicated and expensive.

SUMMARY OF THE INVENTION

The present invention has been made in order to solve the issue described above, and has as its object to provide a starter at lower cost by reducing the number of parts.

The present invention has another object to provide a starting circuit of the starter that realizes to lower the cost by reducing the number of the parts and simplifying the circuit composition.

In the starter for engines according to a first aspect, a starter for engines comprising a motor having an armature that generates torque (energized from a battery by closing a main point of contact provided in a motor circuit), an output shaft that the torque of the motor is transmitted via a clutch, a pinion gear connected with a perimeter of the output shaft via helical spline engagement, a switch coil that is energized from the battery by closing a starting switch, a plunger having the switch coil therein that moves in response to a magnetism that the switch coil generates, and an electromagnetic switch that opens and closes the main point of contact interlocked with a motion of the plunger and pushes out the pinion gear in the direction of an anti-motor side via a shift lever, wherein, the electromagnetic switch is composed of one coil such that the switch coil and a starting circuit are separated electrically.

According to the above-mentioned composition, the electromagnetic switch of the starter is a single coil type that generates the attraction force for attracting the plunger and the holding power for holding the plunger with one switch coil. In this case, the switch coil does not have to be connected to the starting circuit, thus the switch coil and the starting circuit are separated electrically. By this, a connecting terminal for connecting electrically of a conventional attracting coil and an M terminal bolt can be abolished, and the process of connecting an end of the attracting coil to the connection terminal by welding etc. becomes unnecessary. Consequently, the cost can be held low by the reductions of the numbers of the parts and the manufacturing processes.

In the starter for engines according to a second aspect, the electromagnetic switch has a contact cover, which contains the main point of contact inside, and a terminal for energization for energizing the switch coil that the current from the battery flow is fixed on the contact cover, wherein one end of the switch coil is connected to the terminal for energization, and the other end of the switch coil is connected to a ground side.

In the starter for engines according to a third aspect, the starter further has a drive spring that stores a pushing power according to the amount of movements of the plunger until the time that the main point of contact closes after the pinion gear touches a ring gear of an engine, wherein the pinion gear is pushed to the direction of the anti-motor side by the electromagnetic switch, and the stored pushing power that acts to the direction where the pinion gear is pushed to the side of the ring gear via the shift lever, wherein when the pushing power stored in the drive spring is defined as a switch extrusion power, the pinion gear is formed in the mass of 100 grams or less and the switch extrusion power is set to below 70N (Newton) so that the operation current of the electromagnetic switch is set to 12 amperes or less.

In the starter for engines according to a fourth aspect, a permanent magnet is used for a magnetic field of the motor.

In the starting circuit of a starter for engines to a first aspect, the starting circuit of a starter for engines includes a motor having an armature that generates torque (energized from a battery by closing a main point of contact provided in a motor circuit), an output shaft to which the torque of the motor is transmitted via a clutch, a pinion gear connected with to the perimeter of the output shaft via helical spline engagement, a switch coil that is energized from the battery by closing a starting switch, a plunger having the switch coil therein that moves in response to magnetism that the switch coil generates, an electromagnetic switch that opens and closes the main point of contact interlocked with a motion of the plunger and pushes out the pinion gear in the direction of an anti-motor side via a shift lever, a motor circuit for passing current from the battery to the armature via the main point of contact, and a switching circuit for passing current from the battery to the switch coil via the starting switch, wherein, a terminal for energization for energizing the switch coil using the current from the battery is disposed in the switching circuit, and a starter control device that controls starting of the starter is connected between the terminal for energization and the starting switch, so that the energization supplied to the terminal for energization is controlled to a predetermined value by the starter control device.

According to the starter starting circuit of the present invention, in a starter control device, such as an ECU, that controls the energization supplied to the terminal for energization, the current energized in the switch coil from the terminal for energization can be set to below the limit current (the maximum current which can be passed to a starter control device) of a starter control device. Thereby, it is not necessary to arrange a starter relay in the switching circuit, and the relay circuit for controlling the exciting current of the starter relay can also be abolished with abolition of the starter relay. Since it is not necessary to connect the relay circuit to the starting switch, the starting switch can be constituted in one line.

As a result, the cost of the starter starting circuit can be lowered because of the simplified circuit composition, and reduced number of the parts.

In the starting circuit of a starter for engines according to a second aspect, wherein, the starter control device controls the energization supplied to the terminal for energization, the current flow to the switch coil becomes 12 amperes or less.

DETAILED DESCRIPTION OF THE PREFERRED EMBODIMENTS

With reference to the accompanying drawings, hereinafter will be described an embodiment of the present invention.

Figure 1:
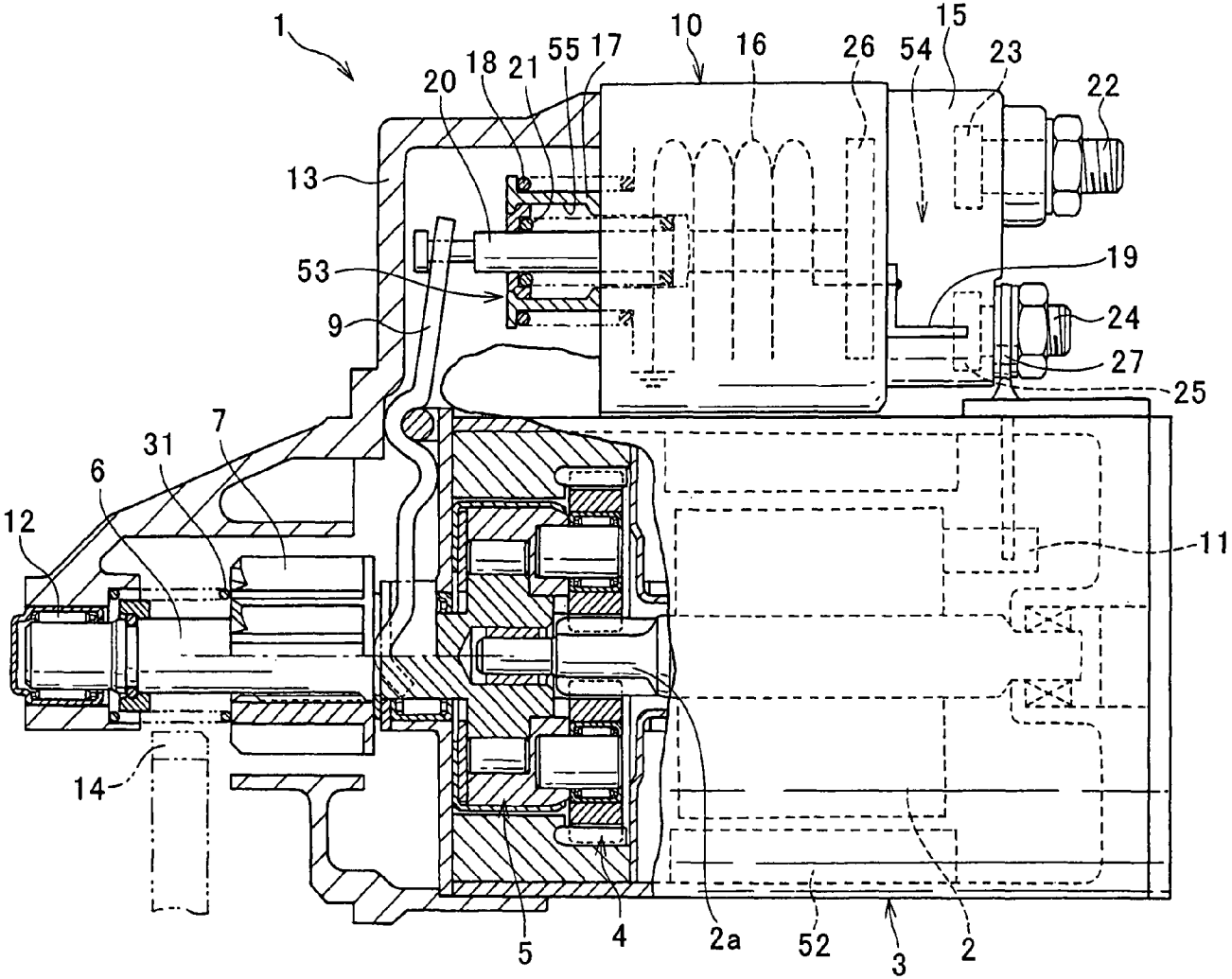
FIG. 1 is a side view of a starter containing a partial section.
Figure 2:
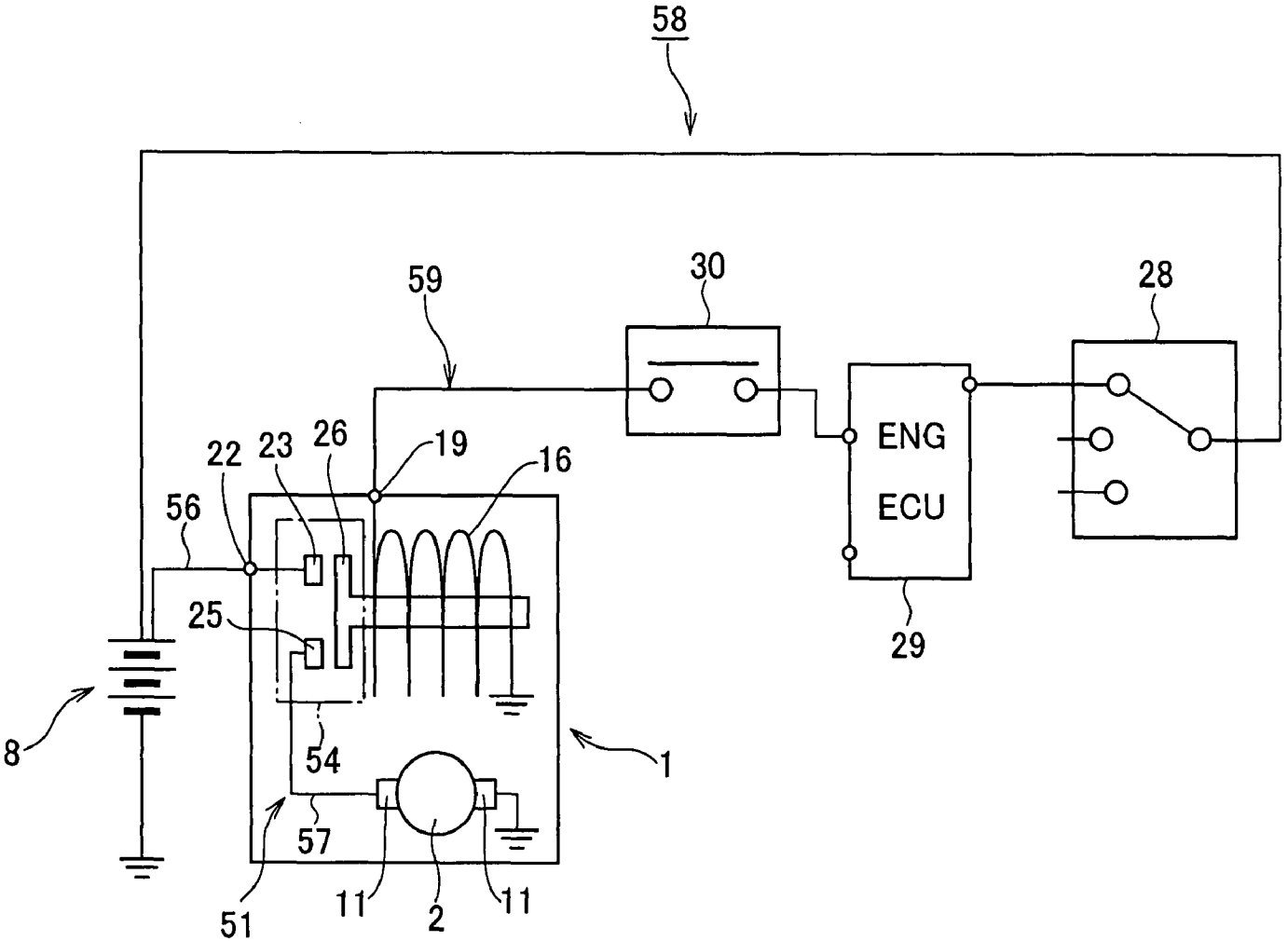
FIG. 2 is a starting circuit diagram of a starter.

FIG. 1 is a side view of a starter containing a partial section and FIG. 2 is a starting circuit diagram of a starter.

As shows in FIG. 1, the starter 1 of this embodiment is comprised of a motor 3 which generates torque to an armature 2 that is build into the motor 3, a speed reducer 4 that slows down the rotation of the motor 3, an output shaft 6 connected to the speed reducer 4 via a clutch 5, a pinion gear 7 that engages in a helical spline manner to the perimeter of the output shaft 6, and a electromagnetic switch 10, etc. The electromagnetic switch 10 opens and closes a main point of contact (described later) provided in a motor circuit 51 for energizing the armature 2 from a battery 8 (referring to FIG. 2), and also pushes the pinion gear 7 towards the anti-motor side (left side in FIG. 1) via a shift lever 9.

The motor 3 is a commutator motor of a magneto field type using a permanent magnet 52 for the magnetic field energizing the armature 2 via a brush 11 that slidably touches to a commutator (not shown).

The speed reducer 4 is a commonly known planetary speed reducer that slows down an armature shaft 2*a* (refer to FIG. 1) of the motor 3 and the output shaft 6 being arranged coaxially.

The clutch 5 is constituted as a one-way clutch 5 that transmits the driving torque of the motor 3 amplified by the speed reducer 4 to the output shaft 6, while cutting off the transfer of the torque between the output shaft 6 and the speed reducer 4 after an engine (not shown) has started and the output shaft 6 becomes an overrun state.

An anti-motor side (left side in the figure) end of the output shaft 6 is supported rotatably by a housing 13 via a bearing 12, and a motor side end is constituted by the clutch 5 as one piece.

The pinion gear 7 engages to a ring gear 14 of the engine side by moving the pinion gear 7 from its stop position shown in FIG. 1 to the direction of an anti-motor side, and drives the ring gear 14 by rotating together with the output shaft 6. The pinion gear 7 of this embodiment is formed in the mass of 100 grams or less.

The electromagnetic switch 10 has a commonly known solenoid 53 that forms an electromagnet by energization and a contact cover 15 fixed to the solenoid 53, and a main point of contact 54 is arranged inside this contact cover 15.

The solenoid 53 has a switch coil 16 (explained in detail below) and a plunger 17 that moves along the axis (horizontal direction in FIG. 1) in the inner circumference of the switch coil 16. When the electromagnet is formed by the energization to the switch coil 16 and a plunger 17 is attracted, the main point of contact 54 is closed interlocking with a motion of the plunger 17. On the other hand, when the energization to the switch coil 16 is stopped and the magnetism of the electromagnet disappears, the plunger 17 is pushed back by a return spring 18 (refer to FIG. 1), and the main point of contact 54 is opened.

One end of an end portion of the switch coil 16 is connected to a terminal for energization (it is called "50 terminal" 19 hereafter) fixed to the contact cover 15, and another end of another end portion of the switch coil 16 is connected to a ground side by being electrically connected to a solenoid case (not shown) or a fixed iron core (not shown), etc. that forms a part of the apparatus. Thus the switch coil 16 is constituted with one coil that is electrically separated from the motor circuit 51. That is, the power for attracting the plunger 17 in order to close the main point of contact 54, and power for holding the plunger 17 in order to maintain the main point of contact 54 in closed state are generated with one switch coil 16.

A concave section 55 is formed in the anti-point-of-contact side (left-hand side in FIG. 1) in the direction of an axis of the plunger 17. A lever hook 20 which transmits a motion of the plunger 17 to the shift lever 9, and a drive spring 21 that stores a pushing power for putting the pinion gear 7 into the ring gear 14 are inserted in the concave section 55. When the pushing power stored in the drive spring 21 is defined as a switch extrusion power, the switch extrusion power is set to below 70N (Newton) with the starter 1 of this embodiment.

The main point of contact 54 is composed of a B (i.e., battery) fixed contact 23 that is connected to the high potential side (the battery side) of the motor circuit 51 via a B terminal bolt 22, an M (i.e., motor) fixed contact 25 connected to the low potential side (the motor side) of the motor circuit 51 via M terminal bolt 24, and a moving contact 26 that moves intermittently between the fixed contacts 23 and 25 together with the plunger 17. When the moving contact 26 touches between both the fixed contacts 23 and 25, both the fixed contacts 23 and 25 are electrically connected and the main point of contact 54 will be in a closed state. On the other hand, when the moving contact 26 separates from both the fixed contacts 23 and 25, the electrical connection between both the fixed contacts 23 and 25 is broken and the main point of contact 54 will be in an open state.

Both B terminal bolt 22 and M terminal bolt 24 are fixed to the contact cover 15. A terminal (not shown) of a battery cable 56 is connected to a tip of the B terminal bolt 22 which projects in the axial direction from the contact cover 15, and a terminal 27 of a motor lead 57 is similarly connected to a tip of the M terminal bolt 24 which projects in the axial direction of the contact cover 15. The motor lead 57 is connected to a plus terminal of the brush 11 (refer to FIG. 2) inside the motor 3.

Next, a starting circuit 58 of the starter 1 is explained based on FIG. 2.

As shown in FIG. 2, the starter starting circuit 58 of this embodiment is comprised with the above-mentioned motor circuit 51 (the circuit for energizing from the battery 8 to the armature 2), and a switching circuit 59 that energize the switch coil 16 of the electromagnetic switch 10 from the battery 8.

In the switching circuit 59, there is connected an ECU 29 (an electronic control unit, or a starter control device), which relates to the starting control of the starter 1, between the 50 terminal 19 and an ignition (starting) switch (hereafter called the IG switch 28). The voltage supplied to the 50 terminal 19 by the ECU 29 is controlled by the predetermined value (12 volts in this embodiment).

In addition, a neutral switch 30 may be arranged between the 50 terminal 19 and the ECU 29. This neutral switch 30 will be in an ON state when a shift position of a gearbox (not shown) is in a neutral position, and it will be in an OFF state at the times other than the neutral position. Therefore, when the neutral switch 30 is in the OFF state, the 50 terminal 19 will not be energized even if the IG switch 28 is turned ON. That is, when the neutral switch 30 is in the ON state, the current which flows from the battery 8 will energize the 50 terminal 19 via the ECU 29 if the IG switch 28 is turned ON.

By the way, when the current (which is defined as operation current) that flows into the switch coil 16 through the 50 terminal 19 at the time the voltage supplied to the 50 terminal 19 from the battery 8 is 12 volts, the operation current is controlled below 12 amperes by the ECU 29. The operation current is determined based on the mass of the pinion gear 7.

Figure 3:
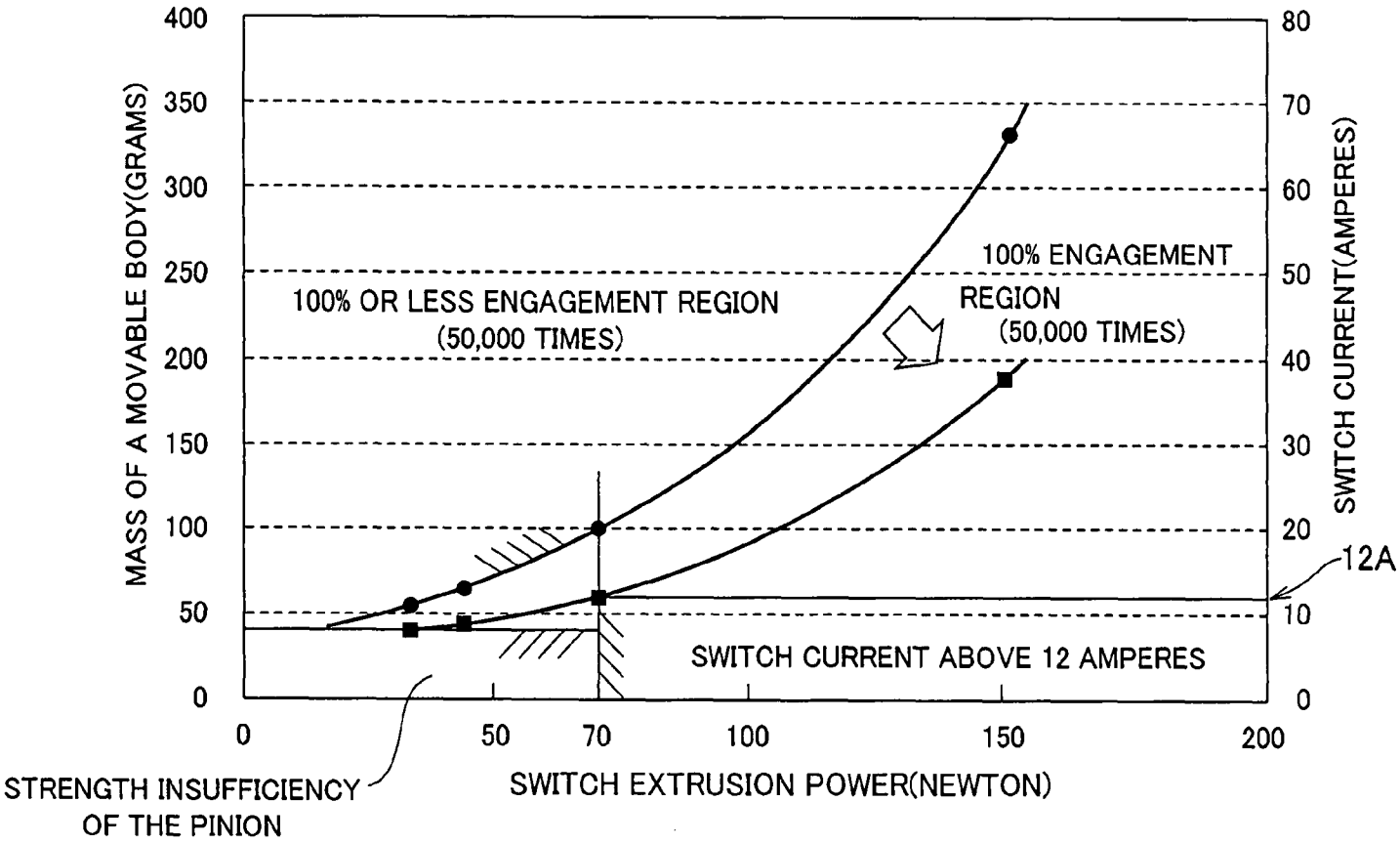
FIG. 3 is a correlation diagram of pinion gear mass, switch extrusion power, and switch current.

That is, the starter 1 of the present embodiment employs a method that pushes only the pinion gear 7 using the power of attraction of the electromagnetic switch 10 (the clutch 5 does not move), and the mass of the pinion gear 7 is set to 100 grams or less. Here, when the desired engagement life of the pinion gear 7 and the ring gear 14 is set to 50,000 times, it is necessary to set the switch extrusion power to 70 Newton or less and the operation current of the electromagnetic switch 10 to 12 amperes or less, as shown in FIG. 3, in order to satisfy the engagement life 100%. Although the mass of the pinion gear 7 can be made small by lessening the number of teeth, since the so physical strength of intensity of the bottom of the teeth is insufficient if the number of teeth becomes seven or less, for example, hence the mass of at least 40 grams or more is required. In the number of teeth, it can be chosen between eight and eleven teeth.

Next, an operation of the starter 1 is explained.

If the IG switch 28 is turned ON, the switch coil 16 is energized and the plunger 17 is attracted therein, thus the movement of the plunger 17 will be transmitted to the pinion gear 7 via the shift lever 9. Thereby, the pinion gear 7 is pushed out in the direction of the anti-motor side along with the helical spline on the output shaft 6, and the end surface of the pinion gear 7 contacts with an end surface of the ring gear 14 and stops.

Then, if the plunger 17 moves further and closes the main point of contact 54, while storing the pushing power in the drive spring 21, the motor 3 is energized from the battery 8 and the torque will occur to the armature 2. The rotation of the armature 2 is slowed down by the speed reducer 4, and is transmitted to the output shaft 6 via the clutch 5.

If the pinion gear 7 rotates to the position where it can engage to the ring gear 14 by rotation of the output shaft 6 with the end surfaces of the pinion gear 7 and the ring gear 14 are contacted, the pinion gear 7 will be pushed out by the pushing power (switch extrusion power) stored in the drive spring 21, and engages to the ring gear 14. Thereby, the driving torque of the motor 3 amplified by the speed reducer 4 is transmitted to the ring gear 14 from the pinion gear 7, and cranks the engine.

If the engine is fully started from the cranking and the speed of the engine rotation exceeds the speed of the starter rotation, since the clutch 5 races, the rotation of the engine is not transmitted to the armature 2 via the speed reducer 4, and the over run of the armature 2 can be prevented.

After the engine has started and the IG switch 28 is turned off, the energization to the switch coil 16 will be stopped and the power of attraction will disappear, therefore the plunger 17 is pushed back by the pushing power of the return spring 18. Consequently, since the main point of contact 54 opens and the energization to the motor 3 from the battery 8 is stopped, the rotation of the armature 2 slows down gradually and stops.

Moreover, when the plunger 17 is pushed back, the shift lever 9 will swing to the opposite direction to that of starting the engine and cancels the pushing force to the pinion gear 7, thus the pinion gear 7 is pushed back to the stop position shown in the FIG. 1 after disengaged from the ring gear 14 by an extrusion power of a pinion gear spring 31 (refer to FIG. 1).

Since the electromagnetic switch 10 of the present embodiment is a single coil type that generates the attraction force for attracting the plunger 17 and the holding power for holding the plunger 17 with one switch coil 16, the number of coils can be reduced and does not need to connect between the switch coil 16 and the M terminal bolts 24 electrically, as compared with the conventional technology of the dual coil type that has an attracting coil and a holding coil separately. By this, a connecting terminal for connecting electrically a conventional attracting coil and an M terminal bolt can be abolished, and the process of connecting an end of the attracting coil to the connection terminal by welding etc. becomes unnecessary. Consequently, the cost can be held low by the reductions of the numbers of the parts and the manufacturing processes.

Since there is one coil for the switch coil 16, one end of the end portion of the switch coil 16 is connected to the 50 terminal 19 (the terminal for energization) similarly to the conventional dual coil type electromagnetic switch having the attracting coil and the holding coil. Further, the other end of the end portion of the switch coil 16 is not necessary to be connected to the motor circuit 51, but may be connected to the ground by connecting electrically to a solenoid case of the electromagnetic switch 10 or to a fixed iron core that forms a part of the magnetic circuit, for example.

Furthermore, since the starter 1 of the present embodiment employs the system of pushing out only the pinion gear 7 independently from the clutch 5, and a mass of a movable body can be made small compared with the starter having the conventional system of pushing out the clutch and the pinion gear together, the attraction force (magnetism that the switch coil generates) required for the electromagnetic switch 10 in order to move the mass of a movable body can be made small.

To be specific, it is possible to set the energization current to the switch coil 16 to 12 amperes or less by setting the mass of the pinion gear 7 to 100 grams or less and the switch extrusion power to 70 Newton or less. By this, the attraction force required for the electromagnetic switch 10 in order to push out the pinion gear 7 in the direction of the anti-motor side, i.e., the magnetism that the switch coil 16 generates, can be made small, therefore even in the case where the switch coil 16 is constituted from one coil, the electromagnetic switch 10 can be made smaller and lighter than those of the dual coil types.

In Addition, since the attraction force of the electromagnetic switch 10 can be made small, the operation current of the electromagnetic switch 10 that is energized to the switch coil 16 can be held down to 12 amperes or less. Thereby, the electromagnetic switch 10 is able to control the operation current directly by the ECU 29, thus it becomes unnecessary to use a starter relay for the switching circuit 59, and the IG switch 28 can be simplified by constituting in one wiring route, therefore the cost can be cut. Further, since it is not necessary to let a large current (for example, about 40 amperes of current) flow in the switching circuit 59, there is also an advantage that the wiring used for the switching circuit 59 can be made thinner.

Since the ECU 29, which carries many electronic components, generally dislikes generation of heat, it cannot directly control a big current, about 40 amperes, but if the current is 12 amperes or less, there will be no special problem occurs since the operation time of the starter in every time is short (about several seconds).

Figure 4:
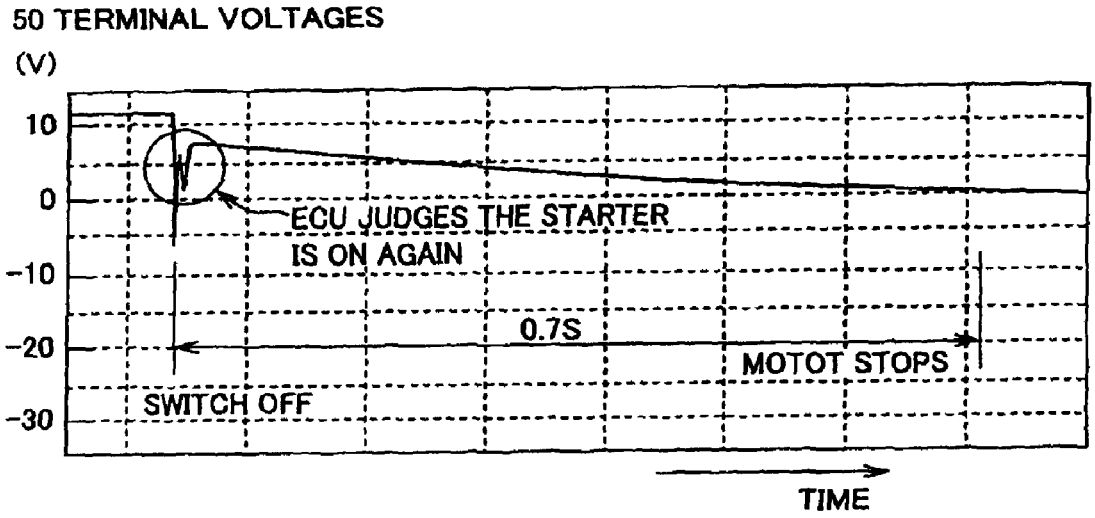
FIG. 4 is a voltage waveform chart of a "50 terminal" concerning the conventional technology.

In the motor 3 that uses the permanent magnet 52 for a magnetic field, a reverse voltage occurs during inertia rotation of the motor 3 after the IG switch 28 is turned off. In this case, since the switching circuit and the motor circuit are connected electrically in the electromagnetic switch of the dual coil type having the attracting coil and the holding coil, the reverse voltage is supplied to the switching circuit. Consequently, as shown in FIG. 4, a voltage waveform (a circled part in the figure) occurs at the 50 terminal, and there is a risk of misjudging by the ECU that the motor has turned on again because of the voltage waveform being detected.

Figure 5:
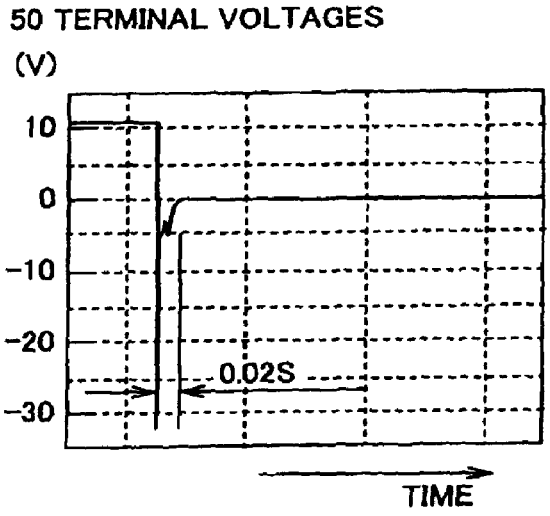
FIG. 5 is a voltage wave form chart of the 50 terminal concerning the present invention.
Figure 6:
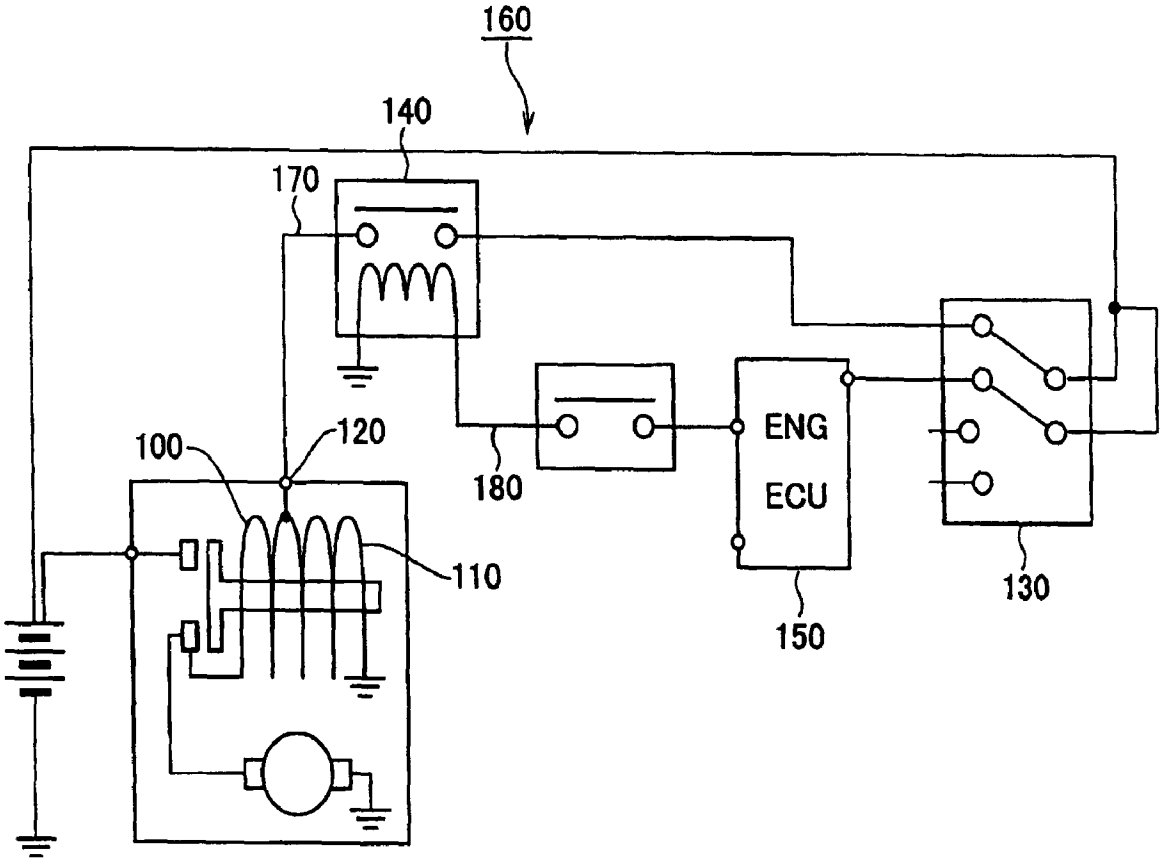
FIG. 6 is a starting circuit diagram of the starter concerning the conventional technology.

On the other hand, because there is one coil for the switch coil 16 of the electromagnetic switch 10 in the present embodiment, the motor circuit 51 and the switching circuit 59 can be separated electrically. That is, since the switch coil 16 is not connected with the motor circuit 51, no reverse voltage enters to the switching circuit 59. By this, as shown in FIG. 5, since no reverse voltage is supplied to the 50 terminal 19, the ECU 29 can detect that the supplied electromotive force to the 50 terminal 19 was set to "0 volt", and the stopped energization to the 50 terminal 19 can be judged instantly.

While the present invention has been disclosed in terms of the preferred embodiments in order to facilitate better understanding thereof, it should be appreciated that the invention can be embodied in various ways without departing from the principle of the invention.

What is claimed is:

1. A starter for engines comprising:

a motor having an armature that generates torque, being energized from a battery by closing a main point of contact provided in a motor circuit;

an output shaft to which the torque of the motor is transmitted via a clutch;

a pinion gear directly connected with a perimeter of the output shaft via a helical spline engagement;

a switch coil that is energized from the battery by closing a starting switch;

a plunger that moves in an inner circumference of the switch coil in response to a magnetism that the switch coil generates; and an electromagnetic switch that opens and closes the main point of contact interlocked with a motion of the plunger and pushes out the pinion gear in a direction of an anti-motor side via a shift lever, wherein the electromagnetic switch is composed with one coil such that the switch coil and a starting circuit are separated electrically, and wherein the pinion gear is pushed out in the direction of the anti-motor side via the shift lever interlocked with the motion of the plunger without moving the clutch in the direction of the anti-motor side.

2. The starter for engines according to claim 1, wherein power for attracting the plunger to close the main point of contact, and power for holding the plunger to maintain the main point of contact in a closed state, are generated by the switch coil having one coil.

3. The starter for engines according to claim 1, wherein one end of the shift lever is positioned between the clutch and the pinion gear.

4. The starter for engines according to claim 1, wherein the electromagnetic switch is set so as to generate a magnetic force that can push out the pinion gear without moving the clutch.

5. The starter for engines according to claim 1, wherein the main point of contact comprises:

a fixed contact that is connected to a high potential side of the motor circuit;

a fixed contact connected to a low potential side of the motor circuit; and a moving contact that moves unitarily with the plunger for connecting the high potential side and the low potential side of the motor circuit.

6. A starting circuit of a starter for engines comprising:

a motor having an armature that generates torque, being energized from a battery by closing a main point of contact provided in a motor circuit;

an output shaft to which the torque of the motor is transmitted via a clutch;

a pinion gear directly connected with a perimeter of the output shaft via a helical spline engagement;

a switch coil that is energized from the battery by closing a starting switch;

a plunger that moves in an inner circumference of the switch coil in response to magnetism that the switch coil generates;

an electromagnetic switch that opens and closes the main point of contact interlocked with a motion of the plunger and pushes out the pinion gear in a direction of an anti-motor side via a shift lever;

a motor circuit for passing current from the battery to the armature via the main point of contact; and a switching circuit for passing current from the battery to the switch coil via the starting switch, wherein a starter control device that controls starting of the starter is connected between a terminal that a current from the battery flows in for energizing the switch coil using the current from the battery and the starting switch, and wherein the electromagnetic switch pushes out the pinion gear without pushing the clutch so that the energization supplied to the switch coil is set below a limit current of the starter control device.

7. The starting circuit of the starter for engines according to claim 6, wherein the starter control device controls the energy supplied from the terminal so that current flowing to the switch coil becomes 12 amperes or less.

8. The starting circuit of the starter for engines according to claim 1, wherein a motor-side end of the output shaft is formed unitarily with the clutch.

* * * * *